US007063650B1

(12) United States Patent
Beausoleil

(10) Patent No.: US 7,063,650 B1
(45) Date of Patent: Jun. 20, 2006

(54) REMOVABLE WEIGHTED FOOTWEAR DEVICE FOR EXERCISE, TRAINING AND/OR THERAPY

(76) Inventor: Luc Beausoleil, 1727 Cochran St., #D, Simi Valley, CA (US) 93065

( * ) Notice: Subject to any disclaimer, the term of this patent is extended or adjusted under 35 U.S.C. 154(b) by 6 days.

(21) Appl. No.: 10/959,781

(22) Filed: Oct. 6, 2004

(51) Int. Cl.
*A63B 21/065* (2006.01)

(52) U.S. Cl. ..... 482/105; 482/79

(58) Field of Classification Search ..... 482/105, 482/124, 74, 121, 79, 80; 36/136, 132
See application file for complete search history.

(56) References Cited

U.S. PATENT DOCUMENTS

| | | | | |
|---|---|---|---|---|
| 2,241,833 | A * | 5/1941 | Waller | 482/105 |
| 3,306,610 | A * | 2/1967 | Biggs, Jr. et al. | 482/105 |
| 3,582,067 | A | 6/1971 | Rucks | 272/57 |
| 4,192,502 | A | 3/1980 | Owen | 272/119 |
| 4,268,917 | A * | 5/1981 | Massey | 2/102 |
| 4,777,743 | A | 10/1988 | Roehrig, Jr. | 36/132 |
| 5,162,032 | A * | 11/1992 | Dohner | 482/105 |
| 5,632,709 | A | 5/1997 | Walsh | 482/105 |
| 5,728,032 | A * | 3/1998 | Glass | 482/105 |
| 5,737,858 | A | 4/1998 | Levy | 36/128 |
| 5,829,170 | A | 11/1998 | Lutz, Jr. | 36/72 |
| 5,893,223 | A | 4/1999 | Glass | 36/132 |
| 6,010,438 | A * | 1/2000 | Fitzgerald | 482/105 |
| 6,052,924 | A | 4/2000 | Sabat | 36/132 |
| 6,149,557 | A | 11/2000 | Williams et al. | 482/105 |
| 6,244,997 | B1 | 6/2001 | Cook | 482/105 |

FOREIGN PATENT DOCUMENTS

GB 2139103 A 11/1984

OTHER PUBLICATIONS

PCT WO 99/56831 Nov. 1, 1999 Borrill.*

* cited by examiner

*Primary Examiner*—Jerome Donnelly
(74) *Attorney, Agent, or Firm*—Head, Johnson & Kachigian

(57) ABSTRACT

A weighted resistance device worn across and around personal foot coverings comprising a forward positioned weight containment pouch; a rear positioned weight containment pouch impermanently and adjustably attached to said forward positioned weight containment pouch; and a foot affixation band attached to said forward positioned weight containment pouch, said band substantially positioned circumferentially about the top, bottom, left and right sides of a foot-worn article.

4 Claims, 2 Drawing Sheets

REMOVABLE WEIGHTED FOOTWEAR DEVICE FOR EXERCISE, TRAINING AND/OR THERAPY

REFERENCE TO PENDING APPLICATIONS

This application is not related to any pending applications.

REFERENCE TO MICROFICHE APPENDIX

This application is not referenced in any microfiche appendix.

TECHNICAL FIELD OF THE INVENTION

The present invention relates generally to a resistance device for use with a foot covering constructed so as to be attachable to the foot covering. The invention more specifically relates to an improved easily affixed and removable footwear device with forward and rear positioned displaceable weight containment pouches for exercise, training and/or therapy.

BACKGROUND OF THE INVENTION

There presently exists a high demand for new and innovative exercise equipment and other devices which increase the fruits of one's exercising efforts. Additionally, members of professional sports teams often look for new training devices that may possibly increase their performance during a game or assist in rehabilitative therapy. Consequently, the market for exercise equipment and other performance improvement devices experience a constantly high demand. Of particular note is the need for an easily affixed and removable device which would neither impede an ice skater or roller blader's flow of motion or shift position during a training or rehabilitative exercise. Contemporary art such as ankle weights serve as examples of such shifting and motion impeding training aids.

Ice skating professionals typically use roller blades (skates) to assist in their training. The unitary row of wheels of a roller blade skate is attached to the bottom, or sole of a boot, which is constructed similarly to a boot of an ice skate. In-line roller skates are further desirable due to the lack of suitable and available ice for ice skating in certain geographic locations at certain times, and due to the intense physical workout engaged in by a user during ice skating. Also, professionals, as well as other users, desire in-line roller skates because of the different venues available for skating, thereby increasing the enjoyment of the workout.

As with all forms of exercise, people desire to develop progressively, that is begin with a relatively easy workout and, in time, progress to a more difficult workout. In this manner, the user's endurance, strength, and speed are steadily increased.

In the case of ice skates or in-line roller skates, the present invention provides a resistance device that can increase the difficulty of the skating motion. The preferred method to do this is to attach a weight to the boot of the skates, so that the user will have to move that weight in order to skate, thereby increasing the difficulty of the workout, and a user's strength and endurance.

There are devices readily available in the market which attach weights to a user's ankles, appropriately named "ankle weights." However, these ankle weights are not particularly useful with in-line roller skates, ice skates or other types of foot coverings. The ankle weights of the prior art typically possess straight, linear edges, thereby preventing conformity of the ankle weights to the external contours of a in-line roller skate boot or other foot covering. Such ankle weights are designed to encompass a human ankle only, and are thus unable to conform to the boot of a in-line roller skate or other foot covering. Additionally, due to the presence of more than two weight chambers in most ankle weights, they were further prevented from conforming to the contours of a skate boot, thereby hampering the appropriate range of motion needed to skate properly. Also, the weight chambers were often stuffed with sand to provide weight, and were prone to rupture, thereby releasing the sand. Accordingly, the ankle weights of the prior art are not practical for such uses as increasing the difficulty of a workout with in-line roller skates, ice skates or in other activities using similar boots or foot coverings.

Accordingly, the present invention provides a novel construction of a resistance device, designed for use with in-line roller skates, ice skates or activities which utilize similar boots or other foot coverings, which can increase a user's strength, speed, and agility. More specifically, the invention is constructed such to introduce a balanced, easily removable and displaceable weighted device constructed of a forward and rear positioned weight containment pouches which not only conform to the exterior configuration of a foot worn article but further allow for unimpeded flow of motion with respect to skating and rehabilitative therapy motions designed to increase a wearer's strength, speed and agility.

BRIEF SUMMARY OF THE INVENTION

A weighted resistance device worn across and around personal foot coverings comprising an forward positioned weight containment pouch; a rear positioned weight containment pouch impermanently and adjustably attached to said forward positioned weight containment pouch; and a foot affixation band attached to said forward positioned weight containment pouch, said band substantially positioned circumferentially about the top, bottom, left and right sides of a foot-worn article.

A general object of the present invention is to provide a resistance device for use with a foot covering constructed so as to be attachable to the foot covering in such a manner so that the resistance device conforms closely to the external configuration of the foot covering.

A more specific object of the instant invention is to provide a weighted resistance device worn across and around personal foot coverings which can be easily adjusted to provide for variable degrees of balanced resistance.

A further object of the invention is to provide a resistance device having weight receiving chambers arranged so that weight is symmetrically disposed on forward and rear sides of a foot covering when the resistance device is properly attached.

Another object of the invention is to provide a resistance device having a quick release arrangement for attaching and disengaging the resistance device from a foot covering.

A further object of the present invention is to provide a resistance device for use with a foot covering which does not hamper of restrict the range of motion when the resistance device is disposed on the foot covering.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

Figure 1:
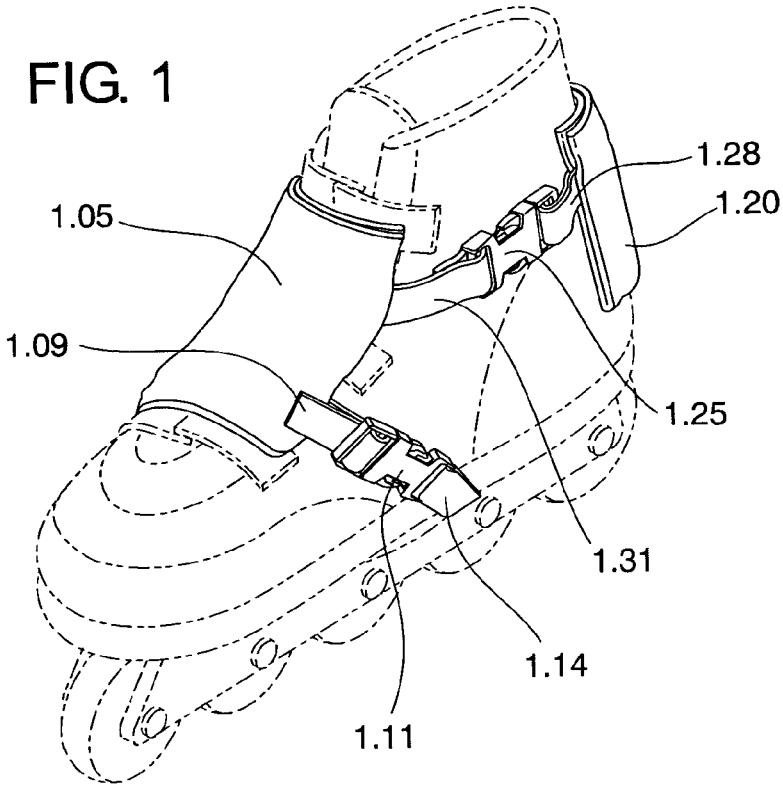
FIG. 1 is a left side frontal view of the instant invention when attached to a roller blade foot covering and practiced in its preferred embodiment.

FIG. 1 illustrates is a left side frontal view of the instant invention when attached to a roller blade foot covering and practiced in its preferred embodiment. As can be seen in FIG. 1, a forward position weight containment pouch 1.05 and a rear position weight containment pouch 1.20 are removably and adjustably attached via a segmented ankle affixation strap 1.31, 1.28 with said segments connected via an attachment means 1.25. It is important to note as used herein, an attachment means as illustrated with respect to the invention's snap/clip combination, could also employ any temporary connection means, such as loop and hook or tying means may be used to effectuate the practices of the invention. FIG. 1 also illustrates a segmented foot affixation strap 1.14, 1.09 which is substantially positioned circumferentially about the top, bottom, left and right sides of the foot worn article 1.12 and with said segments similarly connected via an attachment means 1.11.

Figure 2:
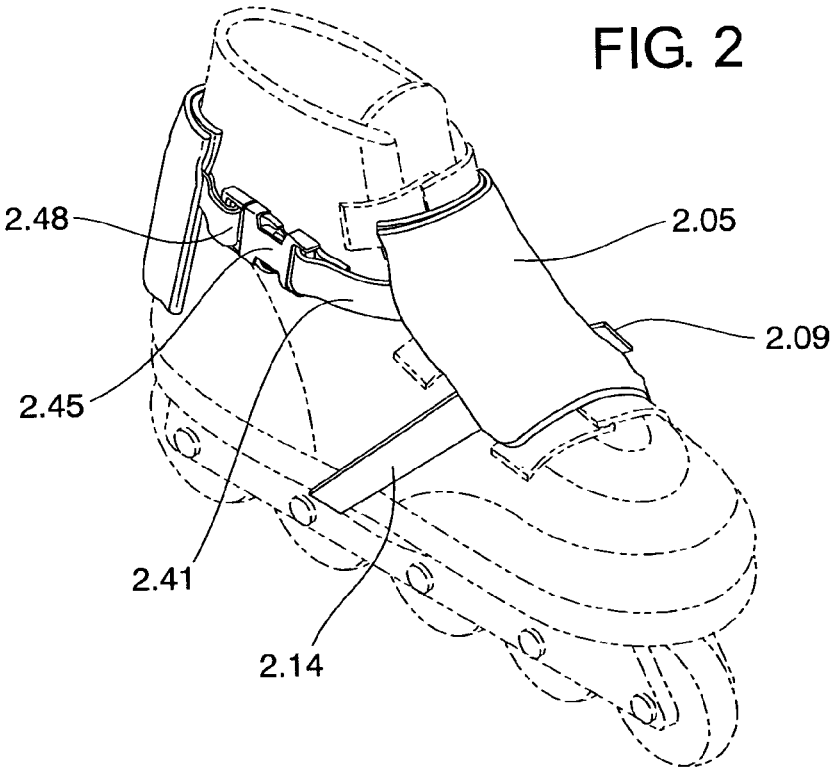
FIG. 2 is a right side frontal view of the instant invention when attached to a roller blade foot covering and practiced in its preferred embodiment.

FIG. 2 illustrates a right side frontal view of the instant invention when attached to a roller blade foot covering and practiced in its preferred embodiment. In FIG. 2 a segment of the foot affixation strap is illustrated as 2.14 with segmented ankle affixation bands illustrated as 2.41, 2.48 connected via attachment means 2.45. FIG. 2 further illustrates the forward position weight containment pouch of the instant invention 2.05 with a partial view of the second segment of said foot affixation strap illustrated as 2.09.

Figure 3:
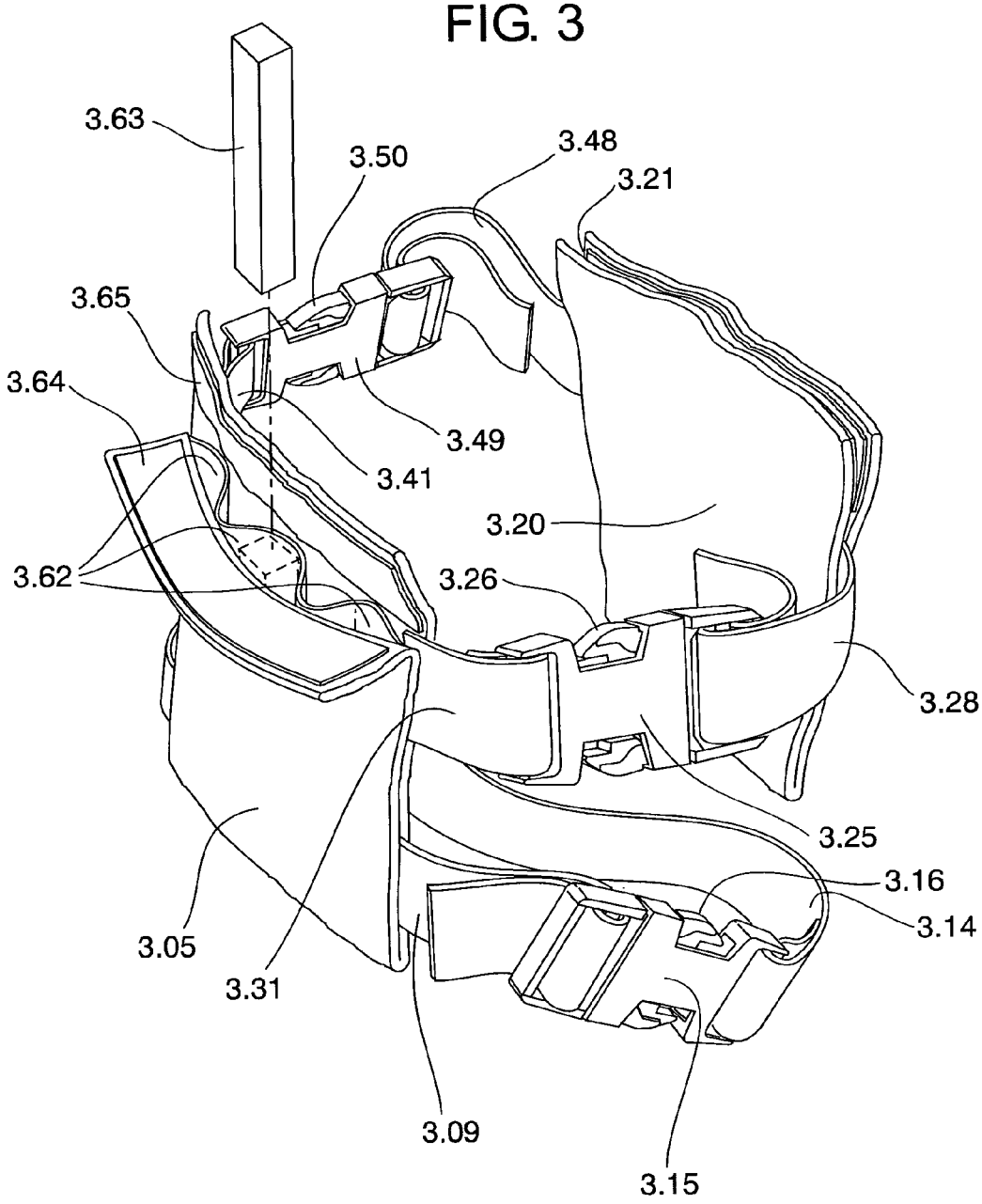
FIG. 3 is an isolation view of the instant invention providing further detail with respect to displaceable weights, forward and rear position weight containment pouches, affixation strap or straps.

FIG. 3 provides greater detail with respect to the instant invention as shown in an isolation view. In FIG. 3 the forward weight containment pouch 3.05 is shown with its weight containing compartments 3.62 clearly illustrated. In practice, a resealable upper edge of the invention's forward weight containment pouch 3.05 and rear weight containment pouch 3.20 allows for access to weight containment pouch compartments 3.62 wherein displaceable weights, such as but not limited to lead or other similarly intended weight structures 3.63 may be inserted and removed. In extensive testing it has been found to be most effective to utilize hook and look material to effectuate the temporary closure and opening of said weight containment pouches. Said hook and loop material for illustrative purposes only illustrated as element 3.64 and 3.65 in FIG. 3. Though shown to be most effectively practiced via utilization of said hook and loop material 3.64 and 3.65, the invention clearly contemplates temporary closure and opening means such as but not limited to snaps, zippers, clips and other similarly intended structures to facilitate said purposes of access to the invention's weight containment compartments 3.62.

FIG. 3 further provides greater detail with respect to the ankle and foot affixation straps of the instant invention. Through extensive testing it has again been found that the segment ankle affixation straps 3.31, 3.28, 3.48 and 3.41 connected via connection means 3.25 and 3.50 respectively allow for greatest flexibility with expect to exact positioning about the wearer's ankle. It is further noted in FIG. 3 that the said ankle affixation straps 3.31, 3.28, 3.48 and 3.41 may be increased or decreased in length to reduce or increase circumferential positioning. Though not illustrated, it is clear a single adjustment accommodation may be utilized to effectuate such positioning. However, the Applicant's experience has been found that allowing variable adjustments on either side of a person's ankle provide for the greatest comfort when practicing the invention in its preferred embodiment. Attention is again drawn to the fact that a variety of adjustable attachment accommodations may be utilized to facilitate the impermanent connection of said forward weight containment pouch 3.05 and rear containment pouch 3.20 about a wearer's ankle. FIG. 3 also illustrates with respect to further detail the segmented foot affixation strap 3.14, 3.09 of the instant invention with a complimenting attachment means illustrated therein as a male member 3.16 and female member 3.15 clipping mechanism.

When practicing the instant invention should the wearer wish to decrease or increase the weight resistance in either or both of the forward 3.05 and rear 3.20 weight containment pouches, the upper edge of said weight containment pouches 3.21 is merely open to facilitate access to the weight containment compartments 3.62. To maintain balance, equal amounts of weights may be removed or introduced to the respective compartments of said forward 3.05 and rear 3.20 weight accommodations. Should a wearer for purposes of therapy or otherwise wish to introduce greater resistance to either the rear weight containment pouch 3.20 or forward weight containment pouch 3.05 he or she merely needs to make the appropriate adjustment and effectuate closure of said weight containment pouches 3.05, 3.20 upper edge. As a practical consideration has been found to be most beneficial to provide access to the weight containment pouches 3.62 of the instant invention via the upper edge 3.21 of said weight containment pouches. However, it is clear alternative placement of a resealable access/egress capability may be provided on one or either of said pouches without varying from the teachings, disclosures and claims of the instant invention. Similarly, the segmented foot affixation straps 3.09, 3.14 and segmented ankle affixation straps 3.31, 3.28, 3.48 and 3.41 may be structured in a manner to provide for affixation via alternative connection means well known and practiced by those skilled in the art without departing from the intent, disclosure and claims of the instant invention. As illustrated in FIG. 3, said affixation straps 3.31, 3.28, 3.48 and 3.41 are attached to forward and rear position weight containment pouches by sewing or otherwise attaching said straps directly to the weight containment pouches. As shown in FIG. 3 an example of such attachment is shown via segmented foot affixation strap 3.09 being inserted between a first and second surface of the forward weight containment pouch and merely being sewn into position. However, the invention may be practiced without departing from its teaching, disclosure and claims by sewing or otherwise connecting one or more of the segmented affixation straps to said forward 3.05 and rear 3.20 position pouches via a multiplicity of means well known to those skilled in the art which include, but are not limited to, clipping, belting, weaving or snapping.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A weighted resistance device worn across and around personal loot coverings comprising:

a forward positioned weight containment pouch;

a rear positioned weight containment pouch removably and adjustably attached to the forward positioned weight containment pouch;

a foot affixation strap having a first end and a second end attached to the forward positioned weight containment pouch said strap substantially positioned circumferentially about the top, bottom, left and right sides of a foot-worn article;

at least one ankle affixation strap having a first end attached to the forward positioned weigh containment pouch and a second end attached to the rear positioned weight containment pouch and substantially positioned circumferentially about a person's ankle;

wherein the foot affixation strap further comprises an attachment means capable of impermanently connecting the first and second ends of the foot affixation strap; and, wherein the attachment means comprises clip mechanism having a male member and a female member.

2. A weighted resistance device worn across and around personal foot coverings comprising:

a forward positioned weight containment pouch;

a rear positioned weight containment pouch removably and adjustably attached to the forward positioned weight containment pouch;

a foot affixation strap having a first end and a second end attached to the forward positioned weight containment pouch said strap substantially positioned circumferentially about the top, bottom, left and right sides of a foot-worn article;

at least one ankle affixation strap having a first end attached to the forward positioned weigh containment pouch and a second end attached to the rear positioned weight containment pouch and substantially positioned circumferentially about a person's ankle;

wherein the foot affixation strap further comprises an attachment means capable of impermanently connecting the first and second ends of the foot affixation strap; and, wherein the attachment means comprises a connecting mechanism including pieces of hook and loop material.

3. A weighted resistance device worn across and around personal foot coverings comprising;

a forward positioned weight containment pouch;

a rear positioned weight containment pouch removably and adjustably attached to the forward positioned weight containment pouch;

a foot affixation strap having a first end and a second end attached to the forward positioned weight containment pouch said strap substantially positioned circumferentially about the top, bottom, left and right sides of a foot-worn article;

at least one ankle affixation strap having a first end attached to the forward positioned weigh containment pouch and a second end attached to the rear positioned weight containment pouch and substantially positioned circumferentially about a person's ankle;

wherein the foot affixation strap further comprises an attachment means capable of impermanently connecting the first and second ends of the foot affixation strap and an adjustment means capable of reducing or increasing circumferential positioning accommodation; and, wherein the attachment means comprises clip mechanism having a male member and a female member.

4. A weighted resistance device worn across and around personal foot coverings comprising:

a forward positioned weight containment pouch;

a rear positioned weight containment pouch removably and adjustably attached to the forward positioned weight containment pouch;

a foot affixation strap having a first end and a second end attached to the forward positioned weight containment pouch said strap substantially positioned circumferentially about the top, bottom, left and right sides of a foot-worn article;

at least one ankle affixation strap having a first end attached to the forward positioned weigh containment pouch and a second end attached to the rear positioned weight containment pouch and substantially positioned circumferentially about a person's ankle;

wherein the foot affixation strap further comprises an attachment means capable of impermanently connecting the first and second ends of the foot affixation strap and an adjustment means capable of reducing or increasing circumferential positioning accommodation; and, wherein the attachment means comprises a connecting mechanism including pieces of hook and loop material.

* * * * *